US005709565A

United States Patent [19]

Okamoto

[11] Patent Number: 5,709,565

[45] Date of Patent: Jan. 20, 1998

[54] PRESS-CONNECTING TERMINAL

[75] Inventor: Masaki Okamoto, Yokkaichi, Japan

[73] Assignee: Sumitomo Wiring Systems, Ltd., Yokkaichi, Japan

[21] Appl. No.: 614,643

[22] Filed: Mar. 13, 1996

[30] Foreign Application Priority Data

Mar. 17, 1995 [JP] Japan ..... 7-086435

[51] Int. Cl.[6] ..... H01R 4/24

[52] U.S. Cl. ..... 439/395

[58] Field of Search ..... 439/395, 396, 439/315

[56] References Cited

U.S. PATENT DOCUMENTS

| | | | |
|---|---|---|---|
| 2,897,584 | 8/1959 | Schumpelt | 439/278 |
| 4,648,673 | 3/1987 | Endo et al. | 439/97 |
| 4,653,830 | 3/1987 | Pegram | 439/97 |
| 5,269,700 | 12/1993 | Mitra | 439/395 |

FOREIGN PATENT DOCUMENTS

| | | | |
|---|---|---|---|
| Y2-57-48062 | 10/1982 | Japan . | |
| 0638338 | 10/1994 | Japan | 439/395 |

*Primary Examiner*—Neil Abrams
*Assistant Examiner*—Katrina Davis
*Attorney, Agent, or Firm*—Oliff & Berridge, P.L.C.

[57] ABSTRACT

A press-connecting terminal is blanked from a pre-plated electrically-conductive metal sheet by a press. A press-connecting groove, formed in this terminal, has a sharp edge portion at an inlet portion thereof. Blanked, sharp edges of the sharp edge portion cut a sheath of a wire. A contact conductive portion is provided below the sharp edge portion. Bent or folded edges of the contact conductive portion contact a conductor of the wire. A plated film is not separated from these folded edge portions, and therefore the contact resistance of these folded edge portions relative to the wire is low.

2 Claims, 3 Drawing Sheets

PRESS-CONNECTING TERMINAL

BACKGROUND OF THE INVENTION

This invention relates to a press-connecting terminal.

A press-connecting terminal has heretofore been often used for making an electrical connection between wires. As is well known, the press-connecting terminal has a press-connecting groove, and when a sheathed wire is press-fitted into this groove, opposed edges of the groove cut or break a wire sheath to come into contact with a conductor in the wire. One such example is disclosed in Examined Japanese Utility Model Publication Sho-57-48062.

The press-connecting terminal is formed by blanking or stamping a blank of a predetermined shape from an electrically-conductive metal sheet by a press, and a plating treatment for providing excellent electrical conductivity is often applied to the press-connecting terminal in order to reduce an electrical resistance thereof. Generally, this plating treatment (pre-plating) is effected before the blanking operation is carried out by the press, and therefore when the blanking operation is effected after the plating treatment, the plated film is removed from stamped edges, so that the substrate of the terminal is exposed. This also occurs at that portion of the terminal where the press-connecting groove is formed, and therefore despite the plating treatment, the wire conductor contacts those portions of the substrate from which the plated film has been removed. As a result, the lowering of the contact resistance is not expected.

Therefore, it has been proposed to effect the plating treatment (post-plating) after the blanking operation by the press; however, there has been encountered a problem that the post-plating is rather cumbersome, and increases the cost.

SUMMARY OF THE INVENTION

The present invention has been made in view of the above problems of the prior art, and an object of the invention is to provide a press-connecting terminal which lowers a contact resistance relative to a wire, and can be manufactured at low costs.

To achieve the above object, according to the invention, there is provided a press-connecting terminal in which the terminal is formed from a metal sheet surfaces of which are beforehand subjected to a plating treatment; the terminal having a press-connecting groove; and when a sheathed wire is press-fitted into the press-connecting groove, edges of the groove cut a sheath of the wire, and are brought into contact with a conductor in the wire; in that the press-connecting groove has a sharp edge portion extending a predetermined length from an inlet of the groove, the sharp edge portion having opposed, exposed edges formed by blanking, which are capable of cutting the sheath of the sheathed wire; the press-connecting groove also has a contact conductive portion extending inwardly from the sharp edge portion; and contact conductive portion-forming portions are formed by blanking during working in such a manner that a gap between opposed edges thereof is smaller than a gap between the opposed edges of the sharp edge portion, and then the opposed edge portions of the contact conductive portion-forming portions are folded outwardly to respectively form opposed folded edge portions capable of contacting the conductor of the wire.

Further, each of the opposed folded edge portions of the contact conductive portion has such a cross-sectional shape that it is sharp at its tip, and is increasing in thickness progressively away from the tip.

In the press-connecting terminal of the present invention, when the sheathed wire is press-fitted into the press-connecting groove, the sheath is first cut or broken by the sharp edge portion provided at the inlet portion of the press-connecting groove. When the wire is further press-fitted, the wire is introduced into the contact conductive portion. The blanked edges are exposed at the sharp edge portion, and therefore a plated film has been removed from these edges. However, the folded portions of the contact conductive portion, from which the plated film are not removed, contact the conductor.

Accordingly, the press-connecting groove has the portion for cutting the sheath, and the portion for contact with the conductor, and the sharp edges of the cutting portion are exposed directly while the folded edges of the contact conductive portion can contact the conductor. Therefore, the inexpensive pre-plating can be used, and besides the conductor contacts those portions on which the plated film is positively retained, so that the contact resistance can be lowered.

Further, each of the opposed folded edge portions of the contact conductive portion has such a cross-sectional shape that it is sharp at its tip, and is increasing in thickness progressively away from the tip. Therefore, the slits, cut in the sheath by the press-connecting groove, are forcibly expanded by this wedge effect, and the contact conductive portion contacts the conductor in this condition.

Accordingly, the slits, cut in the sheath, are forcibly expanded at the contact conductive portion, thereby positively contacting the contact conductive portion with the conductor, so that the electrical connection between the two can be positively achieved.

DETAILED DESCRIPTION OF THE PREFERRED EMBODIMENTS

Figure 1:
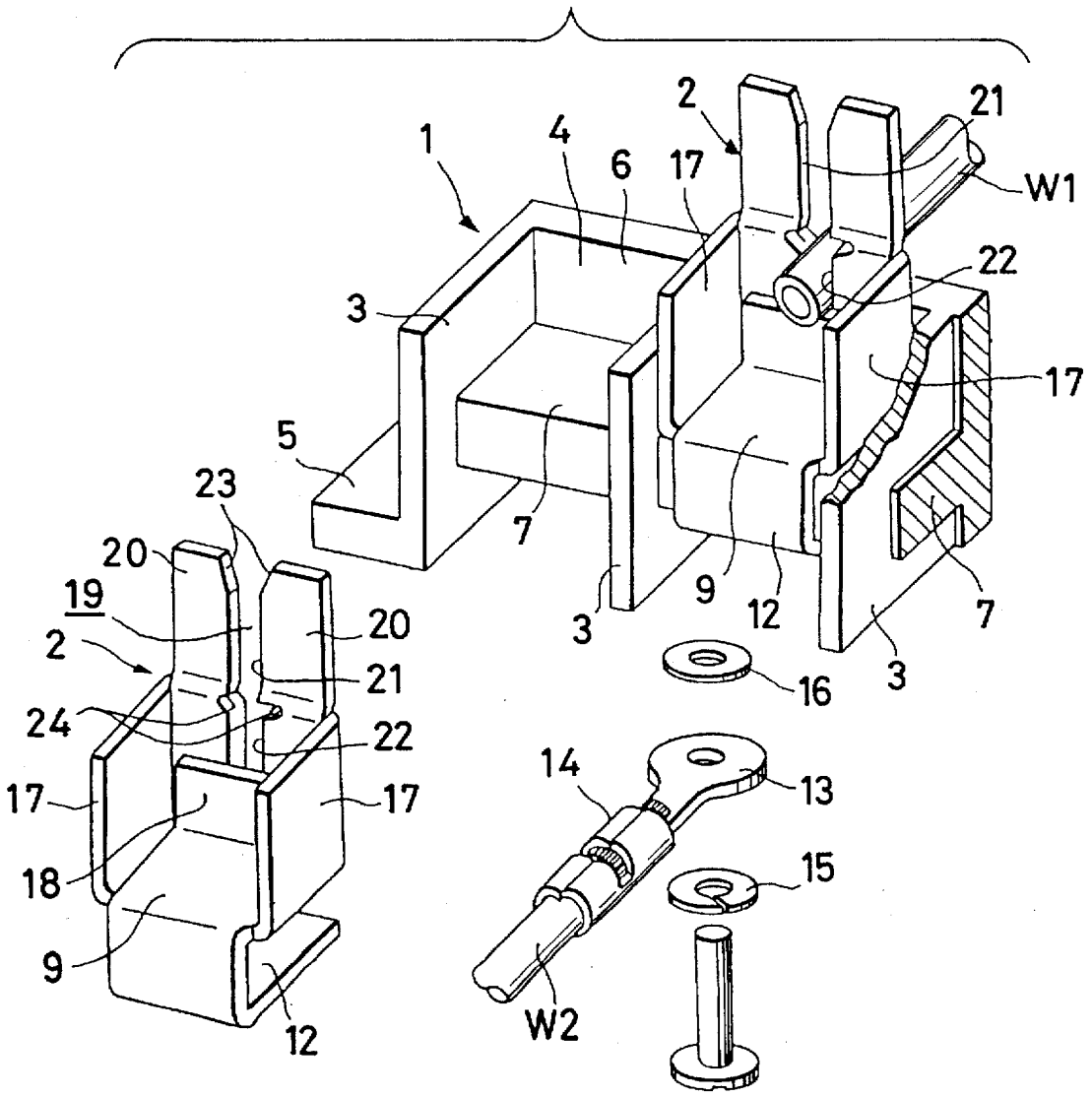
FIG. 1 is a perspective view showing the manner of mounting a press-connecting terminal according to an embodiment of the present invention.
Figure 2:
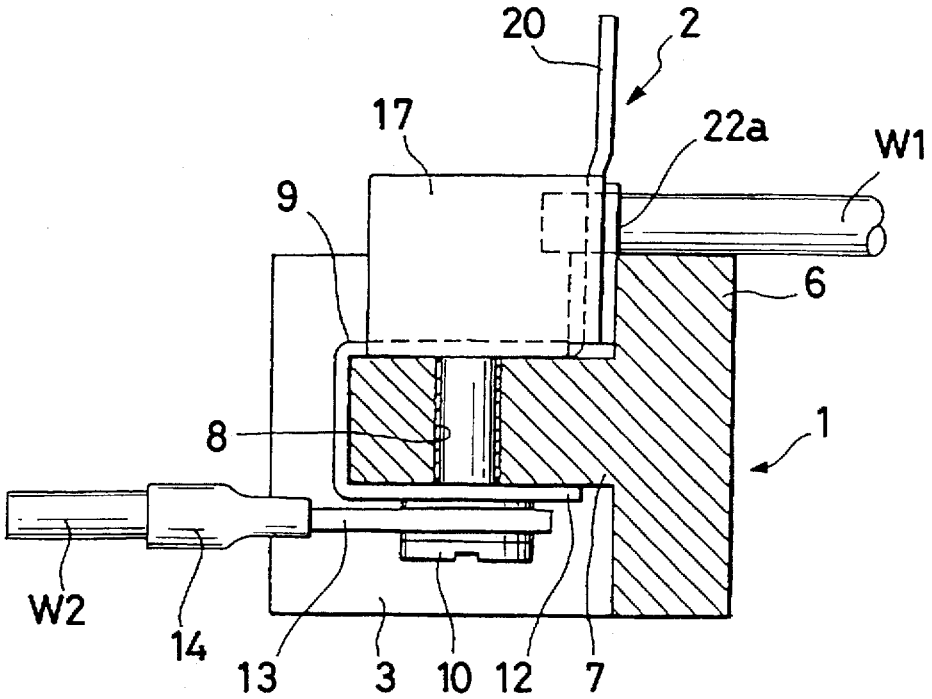
FIG. 2 is a cross-sectional view showing a mounted condition of the press-connecting terminal according to an embodiment of the present invention.
Figure 3:
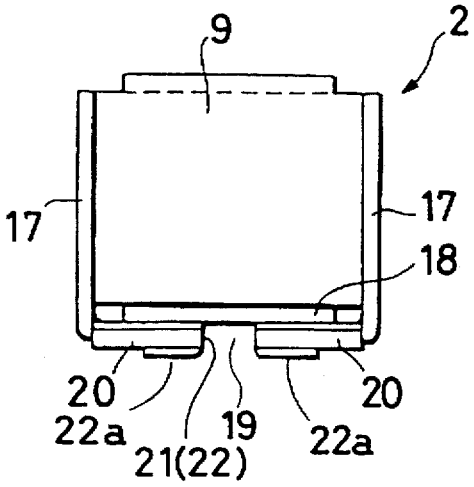
FIG. 3 is a plan view of the press-connecting terminal according to an embodiment of the present invention.
Figure 4:
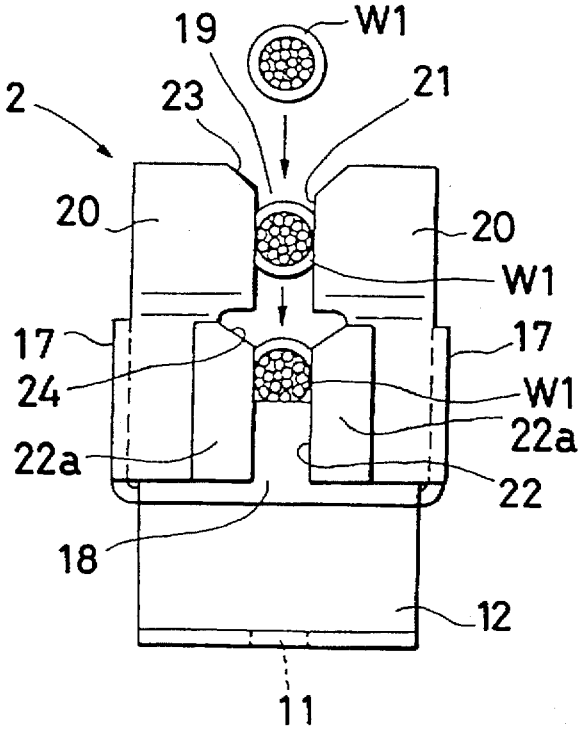
FIG. 4 is a rear view showing the manner of press-fitting a wire into the press-connecting terminal according to an embodiment of the present invention.

A preferred embodiment of the present invention will now be described with reference to FIGS. 1 to 5. In these Figures, a terminal bed 1 on which terminals are mounted is made of an insulating material such as a synthetic resin. This terminal bed 1 is of such a type that a plurality of press-connecting terminals 2 are mounted thereon in juxtaposed relation (although only two of the terminals are shown in the drawings). The terminal bed 1 is divided by partition plates 3 into a plurality of terminal receiving portions 4 which are spaced from one another at equal intervals. A pair of mounting flanges 5 project respectively from the opposite outer partition plates 3 at respective lower ends thereof, and the terminal bed 1 can be fixed to a fixing member (not shown) by screws passing through the mounting flanges 5. The rear side of the terminal bed 1 is covered by a rear plate 6 having the same height as that of the partition plates 3. A seat plate 7 is provided horizontally in each of the terminal receiving portions 4, and is disposed intermediate upper and lower ends thereof. As shown in FIG. 2, a nut member 8 is inserted in the seat plate 7 in each terminal receiving portion 4. The nut member 8 is used for fixedly connecting a wire W2, and is exposed at least to a lower surface of the seat plate 7.

The press-connecting terminal 2 is formed by blanking or stamping a blank of a predetermined shape (in a developed configuration) from an electrically-conductive metal sheet by a press, and then by bending this blank. Before the blanking operation is effected by the press, the electrically-conductive sheet is plated with a material having excellent electrical conductivity over entire surfaces thereof.

The overall shape thereof will be described below. Each press-connecting terminal 2 includes a base plate 9 substantially equal in size to the seat plate 7. A base plate 9 is first bent substantially perpendicularly downwardly to form a front edge, and is further bent inwardly, thereby providing a leg portion 12 having a mounting through hole 11 disposed centrally of the width thereof. A screw 10 is adapted to pass through the mounting hole 11. The seat plate 7 of the terminal bed 1 can be sandwiched between the leg portion 12 and the base plate 9, and after the press-connecting terminal 2 is thus provisionally fitted on the seat plate 7, the press-connecting terminal 2 is fixedly secured by fixedly connecting the wire W2. More specifically, a conductor (not shown) is exposed at a front end of the wire W2, and a clamp terminal 14, having a ring terminal 13 (see FIG. 1), is clamped to this exposed portion of the conductor. The ring terminal 13 is fixedly secured by tightening the screw 10 into the nut member 8, with washers 15 and 16 disposed respectively on lower and upper sides of the ring terminal 13. By doing so, the wire W2 and the press-connecting terminal 2 are fixedly secured to the terminal bed 1 at the same time.

A pair of opposite (opposed) side walls 17 are formed integrally with the base plate 9, and extend upright from opposite sides of the base plate 9, respectively. The opposite side walls 17 face the inner surfaces of the partition plates 3, respectively, when the press-connecting terminal 2 is mounted on the terminal bed 1. In this embodiment, the opposite side walls 17 are slightly greater in height than the partition plates 3, and therefore project from the terminal bed 1. A stopper wall 18 is formed integrally with the base plate 9, and extends upright from the rear edge of the base plate 9. The stopper wall 18 serves to limit the depth of insertion (press-fitting) of a wire W1 into a press-connecting groove 19 (described later), and the stopper wall 18 is smaller in height than the opposite side walls 17, and is substantially equal in height to the rear plate 6 of the terminal bed 1.

A pair of terminal piece portions 20 are formed at the rear side of the press-connecting terminal 2. The terminal piece portions 20 are inwardly bent substantially perpendicularly from the rear edges of the opposite side walls 17, respectively, and are held substantially in intimate contact with the rear surface of the stopper wall 18. When the press-connecting terminal 2 is mounted on the terminal bed 1, the two terminal piece portions 20 are held in intimate contact with the rear plate 6 of the terminal bed 1. With this arrangement, the opening or deformation of the press-connecting terminal 2 is prevented (This will be more fully be described later).

A slit, formed between the two terminal piece portions 20, serves as the press-connecting groove 19 for press-fitting the wire W1 thereinto. The press-connecting groove 19 incudes two portions from a functional point of view, and one is a sharp edge portion 21 provided at the inlet side for cutting or breaking a sheath of the wire, and the other is a contact conductive portion 22 provided at the inner end side (in the press-fitting direction) for electrical connection of a conductor of the wire.

In this embodiment, the sharp edge portion 21 is formed over upper half portions of the two terminal piece portions 20 above the opposite side walls 17, and opposed edges of this portion 21 are sharp, and a gap between these opposed sharp edges is of such a size that the opposed sharp edges can cut the wire sheath to reach the conductor in the wire. The opposed edges of the two terminal piece portions 20 are chamfered as at 23 at their upper end portions so as to guide the wire W1, thereby facilitating the press-fitting operation. Edges of the blanked electrically-conductive sheet are used directly as the opposed edges of the sharp edge portion 21, and therefore even though the press-connecting terminal is beforehand plated as described above, it is quite possible that the plated film is removed from these portions, so that the substrate (that is, the electrically-conductive sheet) is exposed.

On the other hand, the contact conductive portion 22 is formed by folding the lower half portions of the opposed edge portions of the two terminal piece portions 20 into intimate contact with the rear surfaces thereof, respectively, (thereby forming folded portions **22*a*). The contact conductive portion 22 is coaxial with the sharp edge portion 21, and a gap between the opposed edges of the contact conductive portion 22 is of such a size that these opposed edges can contact the conductor of the wire. Thus, the contact conductive portion 22 is not defined by blanked edges formed by the press as in the sharp edge portion 21, but is defined by the opposed, folded edges. Therefore, those portions, having the plated film or layer retained thereon, can be contacted with the wire conductor. Contact conductive portion 22 is separated from sharp edge portion 21 by indentations 24 extending into opposed edges of terminal piece portions 20, as shown in FIG. 1**.

Figure 5:
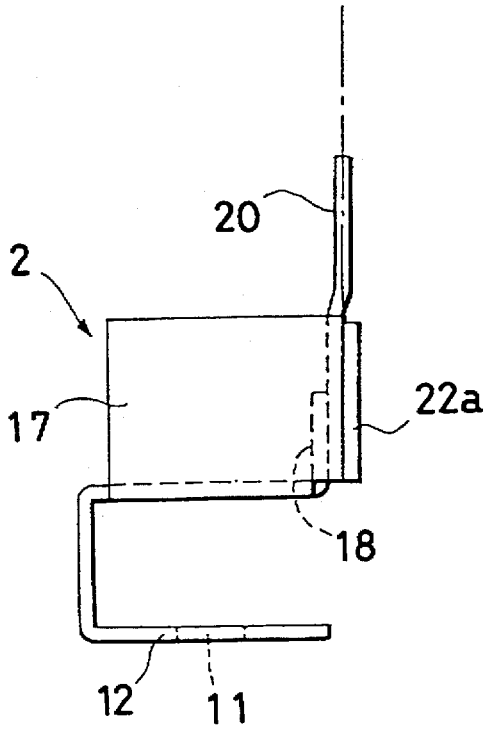
FIG. 5 is a side-elevational view of the press-connecting terminal according to an embodiment of the present invention.

As shown in FIG. 5, in the terminal piece portion 20, the contact conductive portion 22 and the sharp edge portion 21 are slightly offset from each other, and are not flush with each other. With this arrangement, the axis at the opposed edges of the sharp edge portion 21 coincides with the axis at the folded edges (that is, edges of the folded portions) of the contact conductive portion 22. Therefore, when those portions of the wire sheath, cut by the sharp edge portion 21, are introduced into the contact conductive portion 22, these cut portions can be registered with the folded edges of the contact conductive portions 22, respectively.

Figure 6:
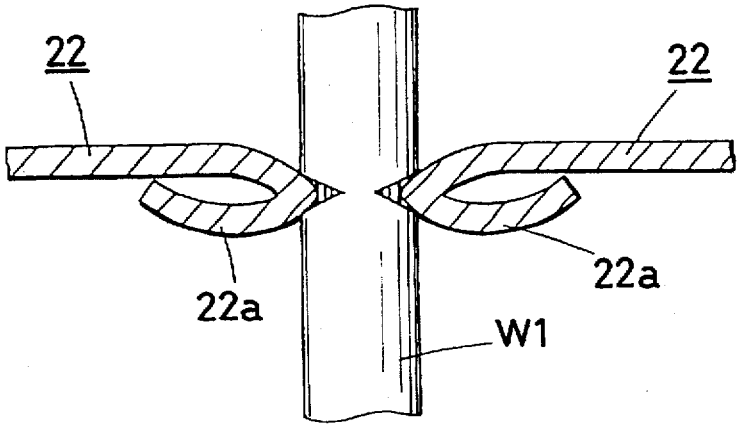
FIG. 6 is an enlarged, cross-sectional view showing a condition of contact between a contact conductive portion and a conductor according to an embodiment of the present invention.

As shown in FIG. 6, the tips of the opposed folded edges of the contact conductive portion 22 are sharp along the direction of the height, and the contact conductive portion 22 is so bent that each of these folded edge portions is increasing in thickness progressively from the tip thereof. Namely, the folded edge portion has a tapering configuration in a horizontal section, and the cut portion formed in the wire sheath can be forcibly expanded by this wedge effect so that the folded edge can positively contact the conductor.

The operation of this embodiment of the above construction will now be specifically described. For connecting the two wires W1 and W2 through the terminal bed 1, the press-connecting terminal 2 is provisionally fixed in the terminal receiving portion 4. More specifically, the press-connecting terminal 2 is forced into the terminal receiving portion 4, with the seat plate 7 sandwiched between the base plate 9 and the leg portion 12 of the press-connecting terminal 2, and the two terminal piece portions 20 are held in intimate contact with the rear plate 6 of the terminal bed 1. As a result, the press-connecting terminal 2 is properly positioned in the terminal receiving portion 4, so that the nut member 8 and the mounting hole 11 are aligned with each other. Then, the ring terminal 13, connected to the wire W2, is registered with the mounting hole 11, and is fixedly secured through the washers 15 and 16 by tightly threading the screw 10 into the nut member 8, so that the wire W1 and the press-connecting terminal 2 are fixed at the same time.

Then, the wire W1 is positioned above the press-connecting groove 19, and is registered with the inlet of the sharp edge portion 21, and then is forced into this groove. Since the upwardly-flaring chamfered portion 23 is formed, the wire can be smoothly introduced into the sharp edge portion 21. As the wire is press-fitted into the sharp edge portion 21, the wire sheath is cut at its right and left sides by the sharp edges, so that these cut portions reach the conductor.

Then, the wire passes through the sharp edge portion 21, and is introduced into the contact conductive portion 22. As described above, the folded or bent edges of the contact conductive portion 22 and the opposed edges of the sharp edge portion 21 are disposed in a common plane, and therefore in so far as the wire is press-fitted straight, the bent or folded edges of the contact conductive portion 22 electrically contact the conductor through the respective cut portions, respectively. Since the folded edge portions of the contact conductive portion 22 have a tapering cross-sectional shape, these edge portions forcibly expand the cut portions in the sheath, respectively, so that the contact conductive portion 22 positively contacts the conductor.

The wires are connected in this manner, and the press-connecting terminal 2 of this embodiment has the following advantages. The sharp edge portion 21 is defined directly by the sharp blanked edges, and therefore can easily cut the sheath, although it is quite possible that the plated film is removed from the sharp edge portion 21. The connection to the wire is made not by the sharp edge portion 21 but by the contact conductive portion 22. Those portions of the contact conductive portion 22 for contact with the conductor are defined respectively by the folded or bent edge portions, and therefore the plated film is retained on these edge portions. Therefore, the conductor can contact the portions having excellent electrical conductivity, so that the contact resistance can be lowered. With this construction, the pre-plating of the electrically-conductive sheet is possible, and the press-connecting terminal 2 can be manufactured at low costs.

The two terminal piece portions 20 are formed by bending, and when the wire 1 is being press-fitted or when an external force is applied to the wire, there is a possibility that the terminal piece portions 20 are deformed in a returning direction to expand the press-connecting groove 19. In this embodiment, however, since the terminal piece portions 20 are mounted on the terminal bed 1 in intimate contact with the rear plate 6 of the terminal bed 1, the above returning deformation will not be encountered, and the width of the press-connecting groove 19 can be always kept constant.

In this embodiment, in order that the opposed edges of the sharp edge portion 21 and the folded or bent edges of the contact conductive portion 22 can be disposed in the common plane, the contact conductive portion 22 is shifted offset rearwardly. However, instead of this offset, the folded edges may be compressed so that the opposed edges of the sharp edge portion and the folded edges of the contact conductive portion can be disposed in the common plane. However, with this method, there is a possibility that the plated film is separated, and therefore the method used in this embodiment is preferred.

In the present invention, various modifications can be made, and the following modification falls within the scope of the invention.

In the above embodiment, although the press-connecting terminal 2 is designed to be mounted on the terminal bed 1, the invention can be applied to the type of press-connecting terminals consisting solely of terminal piece portions 20.

What is claimed is:

1. A press-connecting terminal for electrically connecting wires, produced from metal sheet surfaces of which are beforehand subjected to a plating treatment; said terminal comprising a press-connecting groove, and when a sheathed wire is press-fitted into said press-connecting groove, edges of said groove cut a sheath of said wire, and are brought into contact with a conductor in said wire; said press-connecting groove comprising:

a sharp edge portion extending a predetermined length from an inlet of said groove, said sharp edge portion having opposed, exposed edges formed by blanking, which are capable of cutting the sheath of said sheathed wire; and a contact conductive portion extending inwardly from said sharp edge portion to contact with a conductor of the sheathed wire, the contact conductive portion being formed by blanking during working in such a manner that a gap between opposed edges thereof is smaller than a gap between the opposed edges of said sharp edge portion, and then the opposed edge portions of said contact conductive portion are folded outwardly to respectively form opposed folded edge portions capable of contacting the conductor of said wire.

2. A press-connecting terminal according to claim 1, in which each of said opposed folded edge portions of said contact conductive portion has such a cross-sectional shape that it is sharp at its tip, and is increasing in thickness progressively away from said tip.

* * * * *